US008746915B2

(12) United States Patent
Villard et al.

(10) Patent No.: US 8,746,915 B2
(45) Date of Patent: Jun. 10, 2014

(54) LIGHT EMITTING DIE (LED) LAMPS, HEAT SINKS AND RELATED METHODS

(75) Inventors: Russell G. Villard, Apex, NC (US); Shawn Keeney, Chapel Hill, NC (US); Nicholas DeSilva, Four Oaks, NC (US); Robert Higley, Cary, NC (US); Joshua J. Markle, Raleigh, NC (US)

(73) Assignee: Cree, Inc., Durham, NC (US)

( * ) Notice: Subject to any disclaimer, the term of this patent is extended or adjusted under 35 U.S.C. 154(b) by 143 days.

(21) Appl. No.: 13/194,641

(22) Filed: Jul. 29, 2011

(65) Prior Publication Data

US 2013/0027947 A1 Jan. 31, 2013

(51) Int. Cl.

| | |
|---|---|
| ***F21V 29/00*** | (2006.01) |
| ***F28F 7/00*** | (2006.01) |
| ***F21V 5/04*** | (2006.01) |

(52) U.S. Cl.

USPC ..... 362/110; 362/294; 165/185; 29/592.1

(58) Field of Classification Search

CPC ..... H01L 21/24; H01L 33/20; H05K 7/209; F21V 29/2262

USPC ..... 313/46, 512; 362/294, 294.01, 341, 362/362; 315/112, 32, 35

See application file for complete search history.

(56) References Cited

U.S. PATENT DOCUMENTS

| | | | | |
|---|---|---|---|---|
| 5,575,459 | A * | 11/1996 | Anderson | 362/240 |
| 7,396,142 | B2 * | 7/2008 | Laizure et al. | 362/240 |
| 7,976,211 | B2 * | 7/2011 | Cao | 362/650 |
| 8,018,136 | B2 * | 9/2011 | Gingrich et al. | 313/498 |
| 2001/0033488 | A1 * | 10/2001 | Chliwnyj et al. | 362/231 |
| 2005/0225988 | A1 * | 10/2005 | Chaves et al. | 362/332 |
| 2005/0243550 | A1 * | 11/2005 | Stekelenburg | 362/240 |
| 2006/0007692 | A1 * | 1/2006 | Hsien | 362/382 |
| 2007/0241357 | A1 * | 10/2007 | Yan | 257/98 |
| 2008/0062689 | A1 * | 3/2008 | Villard | 362/250 |
| 2009/0009996 | A1 * | 1/2009 | Scordino et al. | 362/240 |
| 2009/0021944 | A1 * | 1/2009 | Lee et al. | 362/294 |
| 2009/0147517 | A1 | 6/2009 | Li et al. | |
| 2010/0097821 | A1 | 4/2010 | Huang et al. | |
| 2010/0207502 | A1 | 8/2010 | Cao et al. | |
| 2010/0208488 | A1 * | 8/2010 | Luo | 362/555 |
| 2012/0163001 | A1 * | 6/2012 | Bertram et al. | 362/373 |

FOREIGN PATENT DOCUMENTS

| | | |
|---|---|---|
| KR | 10-0922946 | 10/2009 |
| KR | 10-2011-0077187 | 7/2011 |
| WO | WO 2013/019534 | 2/2013 |

OTHER PUBLICATIONS

International Search Report and Written Opinion for Application No. PCT/US2012/048259 dated Jan. 23, 2013.

* cited by examiner

*Primary Examiner* — Tracie Y Green

(74) *Attorney, Agent, or Firm* — Jenkins, Wilson, Taylor & Hunt, P.A.

(57) ABSTRACT

Light-emitting die (LED) Lamps, heat sinks, and related methods are provided. An LED lamp can include a mounting substrate having a top surface, a bottom surface and side edges. An LED package can be disposed on the top surface of the mounting substrate with the LED package comprising an LED chip. The LED lamp can include a heat sink that can include a heat sink base and a spacer extending upward from the base. The spacer can have a mounting area or pad distal from the heat sink base on which the bottom surface of the mounting substrate is disposed. The spacer can also have a width that is less than a width between the side edges of the mounting substrate. The LED lamp can further include a lens disposed over the LED package and the mounting substrate.

17 Claims, 6 Drawing Sheets

LIGHT EMITTING DIE (LED) LAMPS, HEAT SINKS AND RELATED METHODS

TECHNICAL FIELD

The subject matter disclosed herein relates generally to light emitting die (LED or LEDs) lamps and heat sinks that can be used with the LEDs. More particularly, the subject matter disclosed herein relates to LED lamps and related methods that, in some embodiments, can be used in decorative or ornamental luminaries and to heat sinks and related methods that can be used in such embodiments and other LED devices.

BACKGROUND

The B10 lamp designation encompasses a variety of primarily decorative lamps. These lamps are used in ornamental luminaries such as chandeliers, sconces and pendants, in which the lamp is typically visible and contributes to the aesthetics of the luminaire. Because the lamp shape is intended to resemble a candle flame, B10 lamps are commonly called candelabra lamps.

Because B10 lamps are decorative, aesthetics are an important design criterion. In addition, the light source and the associated components must fit in the space-constrained B10 form factor. B10 lamps can have a torpedo shape and are blunt or flame tipped. They typically have a candelabra (E12) or medium (E26) Edison socket base.

There are many incandescent B10 lamps on the market today. These incandescent B10 lamps typically operate at low wattages and produce warm light. Like all incandescent lamps, they are inefficient and have a relatively short lifetime. A number of CFL B10 lamps are also available. They offer energy savings and longer life than incandescents, but they are slow to illuminate. The CFL lamps may be more efficient than incandescent lamps, but they do not match the incandescent lamp's color rendering index (CRI).

Solid-state lighting is becoming increasingly important in the lighting industry. Solid-state lighting refers to a type of lighting that uses light-emitting devices with LEDs such as, for example, semiconductor light-emitting diodes, organic light-emitting diodes, or polymer light-emitting diodes as sources of illumination rather than electrical filaments, plasma (used in arc lamps such as fluorescent lamps), or gas. Various implementations of LED lighting fixtures are becoming available in the marketplace to fill a wide range of applications. Lighting applications in which LEDs can be used can comprise domestic lighting, billboard and display lighting, automotive and bicycle lighting, emergency lighting, traffic and railway lighting, and floodlight and flashlight use. LED lamps use less energy than incandescent lamps for the same output. In addition, LED based lamps have a longer life than standard incandescent light lamps. Accordingly, the use of LEDs in lighting applications can provide significant energy savings, increased lamp life, and flexibility in the design. For these reasons, lighting manufacturers are increasingly interested in unique lighting fixtures incorporating LEDs that may also have appeal to their intended customers.

To date, however, B10 lamps based on a single LED have been unable to match the light output of incandescents. Multi-LED configurations complicate the overall system design and additionally have been incapable of emulating the warm look produced by an incandescent filament. Testing of LED-based B10 lamps conducted by the Department of Energy (DOE) Commercially Available LED Product Evaluation and Reporting (CALiPER) program showed inconsistent lamp performance and quality and instances of inflated performance claims. One issue with the use of LEDs in general, and in lighting applications, in particular, is the management of heat created by the LEDs.

Thus, an LED lamp, particularly in a B10 type design, that can meet the light output of an incandescent filament and that can consistently meet the quality and performance standards set by the DOE is desirable. Further, a heat sink for such a lamp design that is capable of managing the heat created by the LED and is of a small enough size for use in a variety of applications is also desirable.

SUMMARY

In accordance with this disclosure, novel LED lamps, heat sinks, and related methods are provided. In particular, LED lamps, and related methods are provided with at least one LED operable to meet the light output of incandescent filament light bulbs used in, for example, ornamental luminaries. Further, heat sinks are provided that are capable of managing the heat created by an LED and that are of a small enough size for use in a variety of applications. It is, therefore, an object of the disclosure herein to provide novel LED lamps, heat sinks, and methods as described for example in further detail herein.

These and other objects as can become apparent from the disclosure herein are achieved, at least in whole or in part, by the subject matter described herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1:
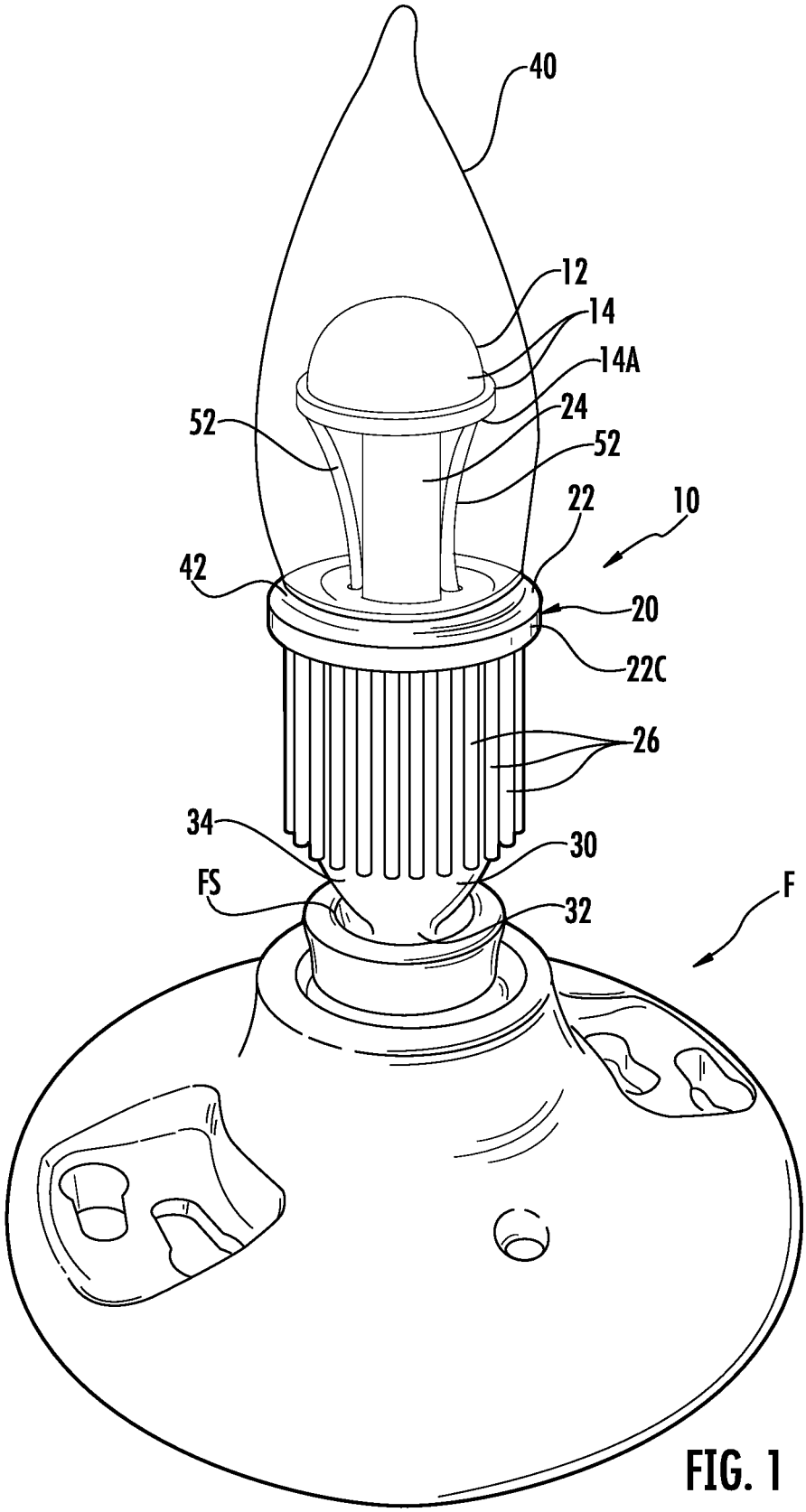
FIG. 1 is a top perspective view illustrating a lighting fixture using an embodiment of an LED lamp according to the subject matter disclosed herein.

Reference will now be made in detail to possible aspects or embodiments of the subject matter herein, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed and envisioned herein covers such modifications and variations.

As illustrated in the various figures, some sizes of structures or portions are exaggerated relative to other structures or portions for illustrative purposes and, thus, are provided to illustrate the general structures of the present subject matter. Furthermore, various aspects of the subject matter disclosed herein are described with reference to a structure or a portion being formed on other structures, portions, or both. As will be appreciated by those of skill in the art, references to a structure being formed "on" or "above" another structure or portion contemplates that additional structure, portion, or both may intervene. References to a structure or a portion being formed "on" another structure or portion without an intervening structure or portion may be described herein as being formed "directly on" the structure or portion. Similarly, it will be understood that when an element is referred to as being "connected", "attached", or "coupled" to another element, it can be directly connected, attached, or coupled to the other element, or intervening elements may be present. In contrast, when an element is referred to as being "directly connected", "directly attached", or "directly coupled" to another element, no intervening elements are present.

Furthermore, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the device in addition to the orientation depicted in the figures. For example, if the device in the figures is turned over, structure or portion described as "above" other structures or portions would now be oriented "below" the other structures or portions. Likewise, if devices in the figures are rotated along an axis, structure or portion described as "above", other structures or portions would now be oriented "next to" or "left of" the other structures or portions. It is understood that these terms are intended to encompass different orientations of the device in addition to the orientation depicted in the figures. Like numbers refer to like elements throughout.

Although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the disclosure herein.

Embodiments of the subject matter of the disclosure are described herein with reference to schematic illustrations of idealized embodiments. As such, variations from the shapes of the illustrations as a result, for example, of manufacturing techniques and/or tolerances are expected. Embodiments of the subject matter disclosed herein should not be construed as limited to the particular shapes of the regions illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the subject matter disclosed herein.

The disclosure herein is directed to light-emitting die (LED) lamps and heat sinks that can be used in such LED lamps or in other LED applications. The term "LED" as used herein can mean an LED chip or an LED package that may comprise an LED chip. The LED lamps can be decorative lamps, such as B10 lamps. Such an LED lamp can comprise a heat sink that can comprise a spacer having a width and a mounting area disposed along a plane. In some embodiments, the spacer of the heat sink can be attached to a heat sink base. An LED can be mounted on the mounting area of the spacer. A first lens can be disposed over the LED with the first lens extending outwardly beyond the width of the spacer and configured to transmit light from the LED above and below the plane of the mounting area of the spacer. The LED can comprise an LED package. In some embodiments, the LED can also comprise an LED package lens. Further in some embodiments, the LED lamp can comprise an outer lens disposed over the LED package, the first lens and the spacer. Thus, in some embodiments, the LED lamp can have three lenses. For example, an LED lamp can have a LED package lens, a first lens that extends over LED package and LED package lens, and an outer lens that extends over the first lens and the LED package and the LED package lens. The light from the LED transmitted through the first lens above and below the plane of the mounting area of the spacer can have a radius that is greater than approximately 180°. In some embodiments, the light from the LED transmitted through the first lens above and below the plane of the mounting area of the spacer can have a radius that is approximately 270° or greater. In some embodiments, the LED lamp can be configured to be a candelabra lamp.

In some embodiments, an LED lamp can comprise a mounting substrate having a top surface, a bottom surface and side edges. An LED package that comprises one or more LED chips can be disposed on the top surface of the mounting substrate. An example of an LED package that can be used can be an XM-L EasyWhite (EZW) LED package, manufactured by Cree, Inc. located in Durham, N.C. XM-L EZW LED package can, for example, have a white light producing LED chip used thereon in manners known in the art. Other examples of LED and LED packages are the XP family of LEDs and related packages also provided by Cree, Inc. located in Durham, N.C.

Such an LED lamp can also comprise a heat sink that can comprise a heat sink base and a spacer extending upward from the heat sink base. The spacer can have a mounting area or pad distal from the base on which the bottom surface of the mounting substrate is disposed. The spacer can also have a width that is less than a width between the side edges of the mounting substrate. Such an LED lamp can further comprise an electrical base attached to the heat sink with the electrical base being configured to engage a light fixture and a driver electrical connected with the LED package and the base.

In some embodiments, the heat sink can comprise a heat sink base having a top surface, a bottom surface and at least one side edge and a spacer having a first and second end. The spacer can be attached to the top surface of the heat sink base at the first end and can extend upward therefrom. The mounting area of the spacer on which the mounting substrate can be disposable can be located on the second end of the spacer. Such a heat sink can also comprise a plurality of pins attached to the bottom surface of the heat sink base and extending downward therefrom. The plurality of pins can form an interior cavity in which the driver can reside.

Such an LED lamp can also comprise a lens disposed over the LED package and the mounting substrate. In some embodiments, the lens can be disposed over the LED package and the mounting substrate with the lens being attached to the mounting substrate and extending outward from the side edges of the mounting substrate to form a bottom lens portion. Such a lens, with the mounting substrate residing on and overhanging the spacer, can permit light to radiate in more than a 180° radius. For example, the lens can refract at least a portion of the light generated by the LED chip downward through a bottom portion of the lens so that the light can radiate from the lamp for example in approximately a 270° radius or greater since the spacer lifts the mounting substrate, LED package, and lens above the heat sink base and does not interfere with such light shining outward from the lamp. For example, the lens can refract at least a portion of the light generated by the LED chip downward through the bottom portion of the lens so that the light can radiate from the lamp in approximately a 360° radius.

Such LED lamps can demonstrate luminous flux and correlated color temperature (CCT) comparable to an incandescent lamp with much higher efficacy. For example, such LED lamps can operate at about 83% less power than a similar B10 incandescent bulb. Further, it is predicted that such LED lamps can easily provide the ENERGY STAR 15,000-hour rated lifetime and last more than approximately 50,000 hours.

FIG. 1 shows an example of a fixture generally designated F with an embodiment of an LED lamp generally designated 10. Led lamp 10 can comprise a lighting unit 12 that can be attached to a heat sink generally designated 20. Heat sink 20 can comprise a spacer 24 having a width and a mounting area disposed along a plane (not shown). In some embodiments, spacer 24 of heat sink 20 can be attached to a heat sink base 22. An LED (not shown) can be mounted on the mounting area of spacer 24. A first lens 14 can be disposed over the LED with first lens 14 extending outwardly beyond the width of spacer 24 as shown in FIG. 1. First lens 14 can be configured to transmit light from the LED above and below the plane of the mounting area of the spacer. The overhanging of lens 14 can form a bottom lens portion 14A that permits the light emitted from the LED to be refracted by lens 14 and transmitted out of bottom lens portion 14A to shine downwardly from lens 14. Thus, in some embodiments, the LED lamp can have three lenses. The light from the LED transmitted through the first lens above and below the plane of the mounting area of the spacer can have a radius that is greater than approximately 180°. In some embodiments, the light from the LED transmitted through the first lens above and below the plane of the mounting area of the spacer can have a radius that is approximately 270° or greater. The LED can comprise an LED package. In some embodiments, the LED can also comprise an LED package lens. Further, in some embodiments, LED lamp 10 can comprise an outer lens 40 disposed over the LED package and package lens, first lens 14 and the spacer 24. Outer lens 40 can be a decorative shape. For example, the LED lamp with a decorative shaped outer lens 40 can be a candelabra lamp.

In some embodiments, lighting unit 12 can comprise a mounting substrate and an LED package (not shown in FIG. 1) under lens 14. As stated above, heat sink 20 can comprise heat sink base 22 and spacer 24 extending upward from heat sink base 22. Lighting unit 12 can be mounted on spacer 24 distal from heat sink base 22. As shown in FIG. 1, spacer 24 can have a width that can be less than a width of lighting unit 12 so that lighting unit 12, and particularly bottom portion 14A (shown in FIGS. 2 and 3) of lens 14, overhangs spacer 22. Lens 14 can be configured to refract light so that light shines downward from the lighting unit 12 from bottom portion 14A of lens 14.

Since spacer 24 can have a smaller width than lighting unit 12 with bottom portion 14A of lens 14 overhanging spacer 24 and since spacer 24 can extend above the wider heat sink base 22 of heat sink 20, heat sink 20 permits a wide radius of light to be emitted from LED lamp 10.

Heat sink 20 can comprise a plurality of pins 26 that can extend vertically downward from heat sink base 22. The plurality of pins 26 can be disposed around and on an outer peripheral portion or edge of heat sink base 22, for example, side edge 22C, creating an interior cavity between pins 26. A driver (not shown in FIG. 1, except for wires 52) for controlling LED lamp 10 can be stored in the interior cavity as described further below. The driver can be electrically connected with the LED package and an electrical base 30. Electrical base 30 can on one end 34 be secured to heat sink 20. Electrical base 30 can on an opposite end 32 be configured to engage a socket FS of light fixture F. For example, electrical base 30 can be configured to engage an Edison socket, a GU-24 socket, other twist and lock sockets, or the like.

LED lamp 10 can also comprise an outer lens 40 that can be secured to heat sink 20. Outer lens 40 can be an enclosure, such as a glass enclosure, that can have a decorative shape. For example and without limitation, the shape of outer lens 40 can be a blunt torpedo shape, a flame tipped shape, or the like. In some embodiments, outer lens 40 can have little or no optical effect on light emitted from lighting unit 12. In some embodiments, outer lens 40 can have some optical effect on light emitted from lighting unit 12. For example, outer lens 40 may reflect light, or certain ranges of the light spectrum, to cause the light from LED lamp 10 to resemble a flickering flame. In some embodiments, outer lens 40 can serve as an optical lens that reflects and refracts light from lighting unit 12. In such embodiments, the outer lens 40 can be a replacement for lens 14. Outer lens 40 can be attached to heat sink 20 in different manners. For example and in one aspect, outer lens 40 can be attached to heat sink base 22 by a thermally conductive adhesive 42, such, as an epoxy. In some embodiments, an epoxy such as KWIK® Plastic epoxy manufactured by J.B. Weld Company located in Sulfur Springs, Tex., can be used to attach outer lens 40 to heat sink base 22.

Figure 2:
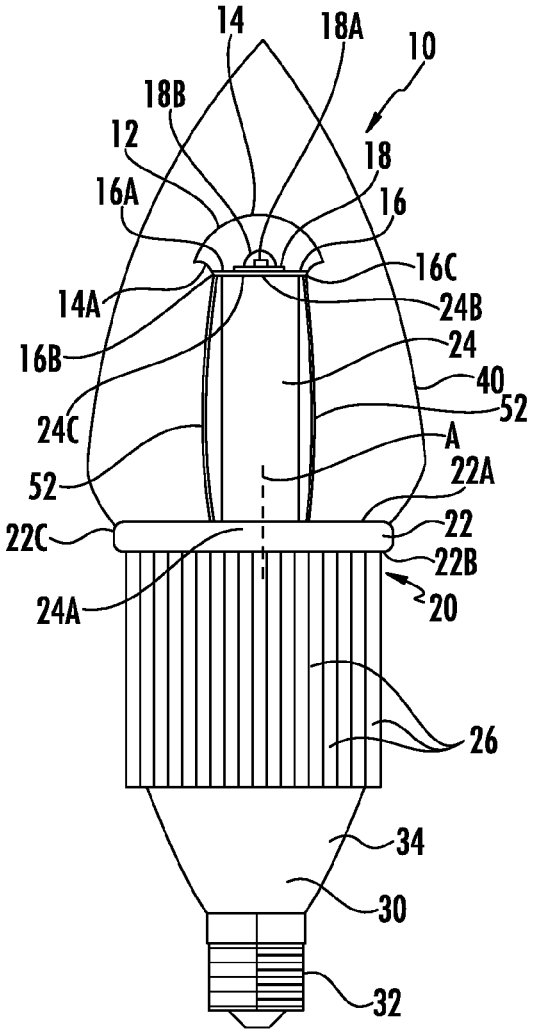
FIG. 2 is a side view illustrating the embodiment of the LED lamp according to FIG. 1.
Figure 3:
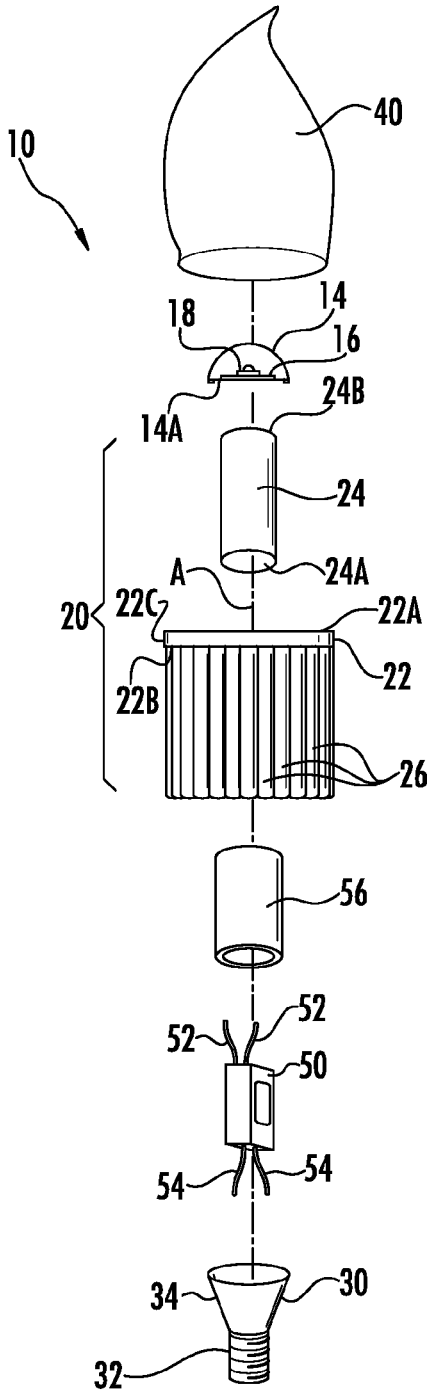
FIG. 3 is an exploded view illustrating the embodiment of the LED lamp according to FIG. 1.
Figure 4:
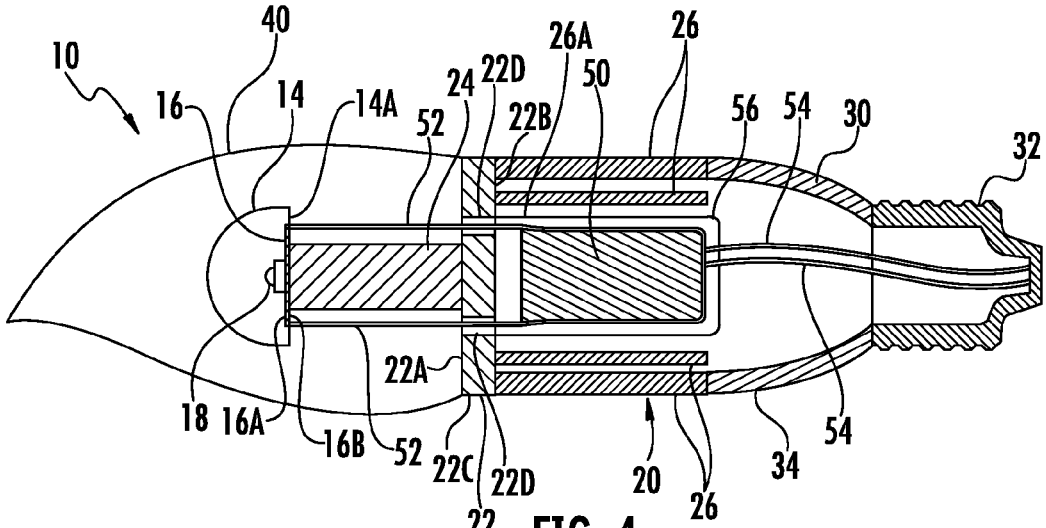
FIG. 4 is a side cross-sectional view illustrating an embodiment of an LED lamp according to the subject matter disclosed herein.

Referring to FIGS. 2-4, LED lamp 10 can comprise a mounting substrate 16 having a top surface 16A, a bottom surface 16B and side edges 16C. Mounting substrate 16 can comprise, for example, a printed circuit board (PCB) that is thermally conductive. For instance, mounting substrate 16 can comprise a metal core PCB (MCPCB). In some embodiments, mounting substrate 16 can comprise a star-shaped PCB or MCPCB. An LED or LED package 18 can be disposed on top surface 16A of mounting substrate 16. LED package 18 can be, for example, an XM-L EZW LED package or a package from the XP family of LEDs and related packages, manufactured by Cree, Inc. located in Durham, N.C. LED package 18 can have one or more LED chips 18A and an LED package lens 18B as well as any other common components such as conductive elements for mounting LED chip 18A and for providing an electrical connection with mounting substrate 16 and/or a driver 50. LED package 18 can be a white LED package, such as an XM-L EZW LED package, and can provide a color consistency comparable to an incandescent lamp without complicated color mixing and give a possible CCT that is also comparable to an incandescent lamp. However, other types of LED packages that use color-mixing, or that use different colors depending on the end use, can be used. A single LED package 18 can be used that can deliver equivalent lighting and greater efficacy than incandescent B10 lamps currently available. For example, the XM-L EZW LED package is a multi-chip LED package that provides lumen output equivalent to existing B10 lamps with excellent LED-to-LED color consistency and improved efficacy and longevity over such incandescent lamps.

Lens 14 can be disposed over LED package 18 and mounting substrate 16. For example, lens 14 can be disposed over LED package 18 and the mounting substrate 16 with lens 14 being attached to mounting substrate 16 and extending outward from the side edges 16C of mounting substrate 16 to form a bottom lens portion 14A. Producing omnidirectional light output from an LED lamp 10 using a directional LED package 18 can be achieved with such a lens 14 (which can be considered a secondary optic to LED package lens 18B). For example, lens 14 can comprise a diffuser dome that refracts at least a portion of the light generated by the LED chip downward through bottom lens portion 14A. For example, lens 14 can be a white diffuser lens manufactured and supplied by Khatod Optoelectronics located in Italy. Such a white diffuser lens 14 can diffuse the light from LED package 18 and produce the omnidirectional light output desired for a B10 lamp. A white lens 14 can obscure the single light source and produces a uniform light pattern. Thus, mounting substrate 16, LED package 18, and lens 14 can make up lighting unit 12.

Figure 6:
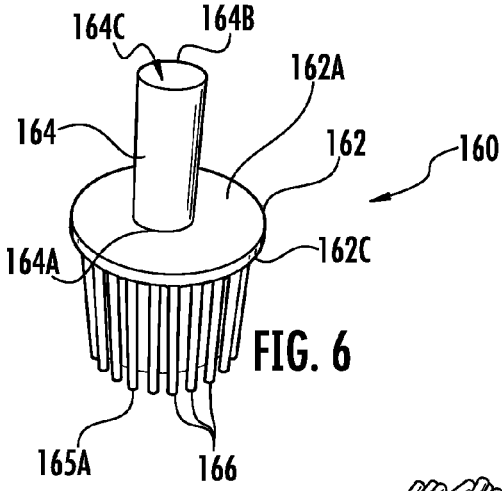
FIG. 6 is a top perspective view illustrating an embodiment of a heat sink according to the subject matter disclosed herein.

Heat sink 20 of LED Lamp 10 can comprise heat sink base 22 having a top surface 22A, a bottom surface 22B and at least one side edge 22C. Heat sink base 22 can be any shape that meets the constraints of the lamp design. For example, heat sink base 22 can have a circular cross-sectional shape as shown in FIG. 6 which has a side edge 22C. Heat sink base 22 can have a square, rectangular, hexagonal, or octagonal cross-sectional shape with multiple side edges, or an elliptical cross-sectional shape, for example. Heat sink base 22 can have a width or a diameter that also meets the criteria for a specific lamp designs. For example and without limitation, for a B10 lamp design, heat sink base 22 can have a diameter of approximately 32 mm or more. As shown in FIG. 4, heat sink base 22 can have apertures 22D that extend therethrough. Wires 52 of driver 50 can pass through apertures 22D to electrically connect driver 50 to LED package 18. For example, mounting substrate 16 can be a MCPCB with wires 52 connecting driver 50 to mounting substrate 16 which is electrically connected to LED package 18. As shown in FIG. 4, wires 52 pass on the outside of spacer 24.

Figure 11:
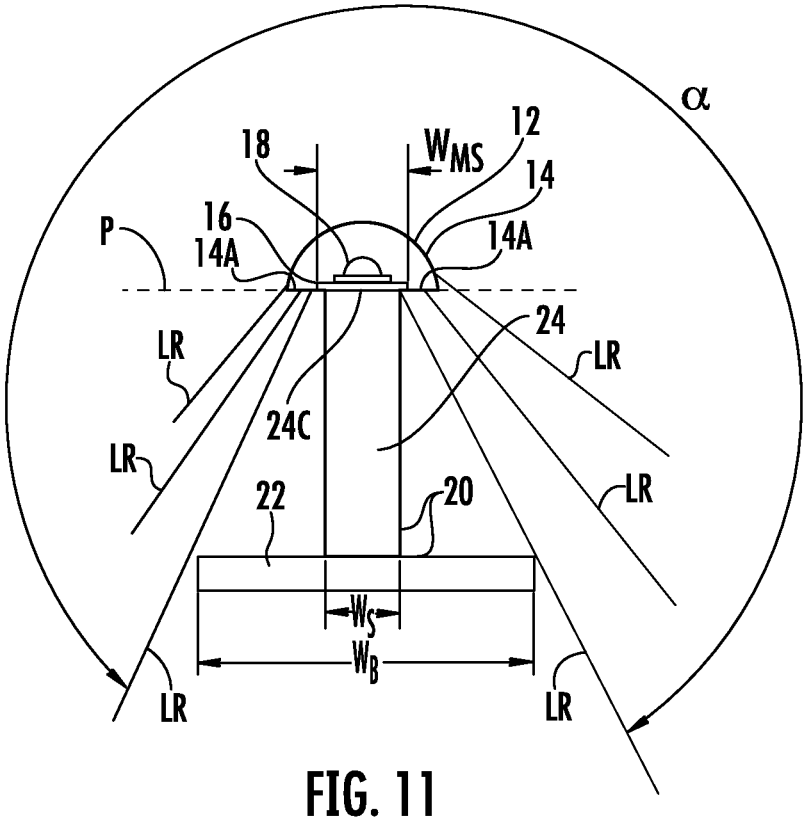
FIG. 11 is a schematic view illustrating operation of a portion of an embodiment of an LED lamp according to the subject matter disclosed herein.
Figure 12:
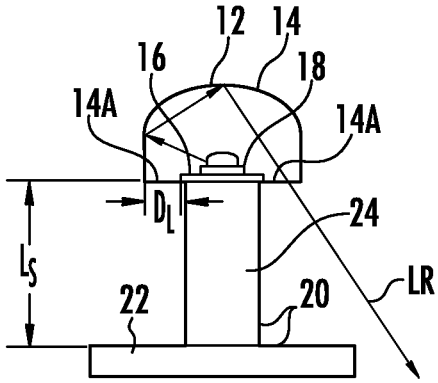
FIG. 12 is a schematic view illustrating operation of a portion of an embodiment of an LED lamp according to the subject matter disclosed herein.

Spacer 24 of heat sink 20 can have a first end 24A and a second end 24B. Spacer 24 can be attached to top surface 22A of heat sink base 22 on first end 24A so that spacer 24 can extend upward from top surface 22A of heat sink base 22. Spacer 24 can form a mounting area, or pad, 24C on second end 24B on which mounting substrate 16 can be secured. Spacer 24 can comprise any shape that will meet the design criteria of the lamp to be produced. For example, spacer 24 can comprise a cylindrical rod. In some embodiments where heat sink base 22 has a circular cross-sectional shape, spacer 24 can have a diameter (represented as width $W_S$ in FIG. 11) that is less than a diameter (represented as width $W_B$ in FIG. 11) of heat sink base 22. For example, spacer 24 can have a diameter that is approximately 30% of a diameter of heat sink base 22. In some embodiments of LED lamp 10 that can be used as a B10 lamp where spacer 24 is a cylindrical rod and heat sink base 22 has a circular cross-sectional shape, the diameter of spacer 24 can be approximately 9.5 mm and the diameter of heat sink base 22 can be approximately 32 mm. In such embodiments, spacer 24 can have a length (represented as length $L_S$ in FIG. 12) that is approximately 25 mm so that mounting substrate 16, LED package 18, and lens 14 can be placed above heat sink base 22 on spacer 24 to minimize light loss within LED lamp 10. As shown in FIG. 11 and FIG. 12, this design allows light that would otherwise be reflected upward to exit lens 14 through bottom lens portion 14A downward and increases the amount of light in the greater than 90° beam angle. For example, as shown in FIG. 11, a radius a of light emitted from lighting unit 12 for an LED lamp can be greater than approximately 180°. For example, the radius a of light emitted from lighting unit 12 for an LED lamp can be approximately 270° or greater. By allowing the radius of emitted light to be so large, LED lamp 10 can closely approximate the light pattern of an incandescent B10 lamp.

Referring back to FIG. 11, spacer 24 can have a width $W_S$ that is less than a width $W_{MS}$ of mounting substrate 16. In this manner, spacer 24 will not generally block light emitted from lighting unit 12. Referring back to FIGS. 2-4, mounting substrate 16 can be secured or attached to spacer 24 in different manners. For example, mounting substrate 16 can be attached to spacer 24 by a thermally conductive adhesive.

Spacer 24 can comprise a thermally conductive material. For example, spacer 24 can comprise a metal such as aluminum. Additionally, spacer 24 can be secured or attached to heat sink base 22 in different manners. For example, spacer 24 can be attached to heat sink base 22 by a thermally conductive adhesive. Alternatively, spacer 24 can be attached to heat sink base 22 by soldering. Further, spacer 24 can be integral with heat sink base 22 making spacer 24 and heat sink base 22 a singular unit. Thus, spacer 22 not only can improve optical efficiency, but it can also provide a thermal path to dissipate heat. Heat sink base 22 can align with spacer 24 along a central axis A as shown in FIGS. 2 and 3, such that the central axis of heat sink base 22 aligns with the central axis of spacer 24.

Heat sink 20 of LED Lamp 10 can comprise a plurality of pins 26 attached to the bottom surface 22B of heat sink base 22 and extending downward therefrom. The plurality of pins 26 can form an interior cavity 26A (see FIG. 4) in which driver 50 can reside. LED lamp 10 can comprise a protective cylinder 56 disposed between the plurality of pins 26 and the driver 50 to protect driver 50 and/or minimize its exposure. Driver 50 can for example be a CE/UL certified constant current driver. For instance, driver 50 can be a CE/UL certified constant current driver manufactured by Wayjun Technology Co., Ltd. located in Guangdong, China. Driver 50 can for example provide efficiency of about 80% and a power factor of about 0.53.

As described above, driver 50 can be electrically connected to LED package 18 and/or mounting substrate 16 via wires 52 and electrically connected to electrical base 30 via wires 52. Electrical base 30 can comprise a socket engaging portion 32 and an insulator portion 34 which can be plastic, glass or the like. Electrical base 30 can be attached to heat sink 20 in different manners. For example, electrical base 30 can be attached to heat sink base 22. In such embodiments, insulator portion 34 of electrical base 30 can comprise protective cylinder 56. In some embodiments, electrical base 30 can be attached to the plurality of pins 26.

Pins 26 of heat sink 20 can extend vertically downward from bottom surface 22B in different manners and extend at least generally parallel to each other and be spaced-apart to allow for air to pass between pins 26. For example, in some embodiments, where heat sink base 22 has a circular cross-sectional shape, the plurality of pins 26 can extend vertically downward from and orthogonal to a horizontally disposed bottom surface 22B adjacent side edge 22C of heat sink base 22 to form interior cavity 26A between the plurality of pins 26. In some embodiments, the plurality of pins 26 can extend downward from bottom surface 22B in a single row adjacent side edge 22C of heat sink base 22. In some embodiments, the plurality of pins 26 can extend downward from bottom surface 22B in two rows adjacent side edge 22C of heat sink base 22.

Pins 26 of heat sink 20 can be a thermally conductive material. For example, pins 26 of heat sink 20 can comprise a metal such as aluminum. Additionally, pins 26 of heat sink 20 can be secured or attached to heat sink base 22 in different manners. For example, pins 26 of heat sink 20 can be attached to heat sink base 22 by a thermally conductive adhesive. Alternatively, pins 26 of heat sink 20 can be attached to heat sink base 22 by soldering. Additionally, pins 26 of heat sink 20 can be integral with heat sink base 22 making pins 22 and heat sink base 22 a singular unit. Further, in some embodiments, spacer 24, the plurality of pins 26 and heat sink base 22 can form an integral unitary body for heat sink 20.

In some embodiments, some or all of heat sink 20 can be a black anodized metal. For example, heat sink 20 can be a black anodized aluminum. Thus, heat sink 20 can improve thermal efficiency for LED lamp 10 to dissipate heat.

An LED lamp 10 that uses an LED package 18 operating at four watts of power, at steady state temperature, can improve its perform by having a heat sink 20 to dissipate the thermal load. In such an LED lamp 10, heat sink 20 not only dissipates the heat generated by LED, but can also provide a mechanical frame for the LED, optic, driver and base while still fitting into the B10 standard enclosure, if so desired. The small size of the B10 form factor can benefit from a heat sink for an LED lamp 10 due to its ability in some embodiments to fit heat sink 20 into the available space and still dissipate heat at a desired rate.

LED lamp 10 can also comprise an outer lens 40 that is secured to heat sink 20 as described above. Outer lens 40 can be an enclosure, such as a glass enclosure, that can have a decorative shape. For example, in some embodiments, LED lamp 10 can be configured to be a candelabra lamp. Thus, in some embodiments, LED lamp 10 can have three lenses. For example, LED lamp 10 can have a LED package lens 18B, a first lens 14 that extends over LED package 18 and LED package lens 18B, and an outer lens 40 that extends over first lens 14 and LED package 18 and LED package lens 18B.

In such an embodiment, LED lamp can transmit light from LED 18 above and below a plane (not shown) of mounting area 24C of spacer 24. In particular, first lens 14 can be configured to transmit light from LED 18 above and below the plane of mounting area 24C of spacer 24. The overhanging of lens 14 can form a bottom lens portion 14A that permits the light emitted from LED 18 to be refracted by lens 14 and then transmitted out of bottom lens portion 14A to shine downwardly from lens 14. In such embodiments, the light from the LED transmitted through the first lens above and below the plane of the mounting area of the spacer can have a radius that is greater than approximately 180°. In some embodiments, the light from the LED transmitted through the first lens above and below the plane of the mounting area of the spacer can have a radius that is approximately 270° or greater.

Figure 5:
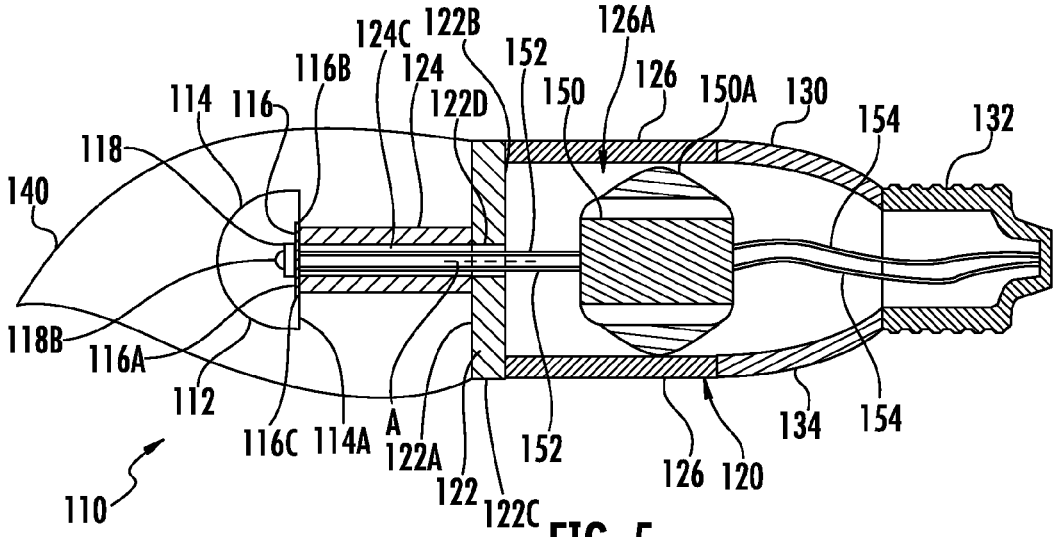
FIG. 5 is a side cross-sectional view illustrating another embodiment of an LED lamp according to the subject matter disclosed herein.

FIG. 5 shows another embodiment of an LED lamp generally designated 110. Led lamp 110 can comprise a lighting unit 112 that is attached to a heat sink generally designated 120. Lighting unit 112 can comprise a mounting substrate 116 and an LED package 118 under a lens 114. Mounting substrate 116 can have a top surface 116A, a bottom surface 116B and side edges 116C. Mounting substrate 116 can comprise, for example, a PCB that is thermally conductive. As above, mounting substrate 116 can comprise a MCPCB. LED package 118 can be disposed on top surface 116A of mounting substrate 116. LED package 118 can have one or more LED chips (not shown) and an LED package lens 118B as well as other common components such as conductive elements for mounting LED chip 118A and for providing an electrical connection with mounting substrate 116 and/or a driver 150. Also as above, lens 114 can be disposed over LED package 118 and mounting substrate 116. For example, lens 114 can be disposed over LED package 118 and mounting substrate 116 with lens 114 being attached to mounting substrate 116 and extending outward from side edges 116C of mounting substrate 116 to form a bottom lens portion 114A.

Heat sink 120 can comprise a heat sink base 122 and a spacer 124 extending upward from a top surface 122A of heat sink base 122. Mounting substrate 116 can be mounted on spacer 124 distal from heat sink base 122. As shown in FIG. 5, spacer 124 can have a width that can be less than a width of mounting substrate 116 so that mounting substrate 116 and a bottom portion 114A of lens 114 overhang spacer 122. Lens 114 can be configured to refract light so that light shines downward from the lighting unit 12 from bottom portion 114A of lens 114. Since spacer 124 can have a smaller width than mounting substrate 116 with bottom portion 114A of lens 114 overhanging spacer 124 and since spacer 124 can extend above the wider heat sink base 122 of heat sink 120, heat sink 120 can permit a wide radius of light to be emitted from LED lamp 110.

Heat sink 120 can comprise a plurality of spaced-apart pins 126 that can extend downward from heat sink base 122. In the embodiment shown in FIG. 5, heat sink base 122 can have a circular cross-sectional shape and the plurality of pins 126 can extend orthogonally away and downward from bottom surface 122B adjacent side edge 122C of heat sink base 122 to form an interior cavity 126A between and surrounded by the plurality of pins 126. The plurality of pins 126 can extend downward from bottom surface 122B in a single row adjacent side edge 122C of heat sink base 122. Driver 150 for controlling LED package 118 can be wrapped in electrically insulative adhesive tape 150A and stored in interior cavity 126A. In such an embodiment, LED lamp 110 can be provided without a protective cylinder for driver 150.

Driver 150 can be electrically connected to LED package 118 and/or mounting substrate 116 via wires 152 and electrically connected to electrical base 130 via wires 154. Electrical base 130 can comprise a socket engaging portion 132 and an insulator portion 134 which can be plastic, glass or the like. Electrical base 130 can be attached to heat sink 120 in different manners. For example, electrical base 130 can be attached to heat sink base 122. Electrical base 130 can be attached to the plurality of pins 126 as shown in FIG. 5. Also in the embodiment shown in FIG. 5, heat sink base 122 can have an aperture 122D that extends therethrough along a central axis A. Further, spacer 124 can be positioned along central axis A of heat sink base 122 and can have an aperture 124C therethrough that aligns with aperture 122D in heat sink base 122.

Wires 152 of driver 150 can pass through aperture 122D in heat sink base 122 and aperture 124C in spacer 124 to electrically connect driver 150 to mounting substrate 116 and LED package 118. For example, mounting substrate 116 can be an MCPCB with wires 152 connecting driver 150 to mounting substrate 116, which is electrically connected to LED package 118. As above, LED lamp 110 can also comprise an outer lens 140 that can be secured, for example to heat sink 20, as described above. Outer lens 140 can be an enclosure, such as a glass enclosure, that can have a decorative shape.

Figure 7:
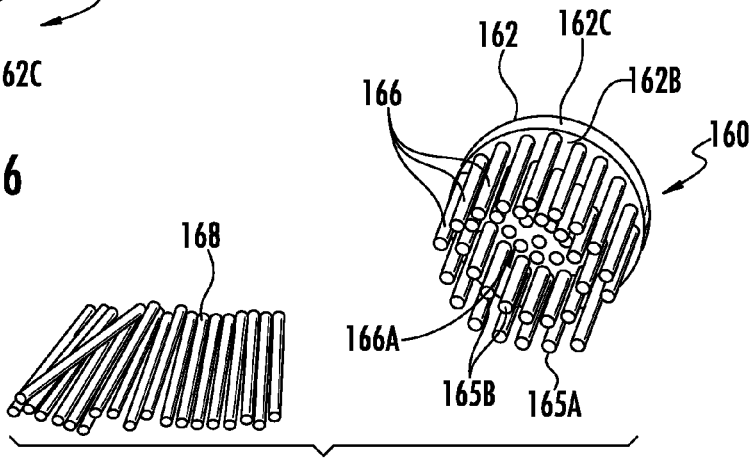
FIG. 7 is a bottom perspective view illustrating the embodiment of the heat sink according FIG. 6.

FIGS. 6-10 illustrate different embodiments of a heat sink. For example, FIGS. 6 and 7 show a heat sink generally designated 160 for use with an LED that is similar to the heat sinks described above. Heat sink 160 can comprise a heat sink base 162 having a top surface 162A, a bottom surface 162B and at least one side edge 162C. Heat sink 160 can comprise a spacer 164 having a first end 164A and a second end 164B. Spacer 164 can be attached at first end 164A to top surface 162A of heat sink base 162. Spacer 164 can extend upward from top surface 162A of heat sink base 162. Spacer 164 can have a mounting area, or pad, 164C on second end 164B on which an LED can be disposed through, for example, the use of an LED package or a mounting substrate. A plurality of pins 166 can be attached to and extend downward from bottom surface 162B of heat sink base 162. As shown in FIG. 6, heat sink base 162 can have a circular cross-sectional shape and the plurality of pins 166 can extend orthogonally away and downward from bottom surface 162B in two rows 165A, 165B proximate side edge 162C of heat sink base 162 as shown to form an interior cavity 166A between the plurality of pins 166. Heat sink 160 can have interior pins 168 (shown removed in FIG. 7) that can be removed to form interior cavity 166A, or can be left attached to heat sink base 162 if an interior cavity is not desired for the intended use of heat sink 160.

Heat sink base 162, spacer 164 and pins 166 of heat sink 160 can be a thermally conductive material. For example, heat sink base 162, spacer 164 and pins 166 of heat sink 160 can comprise a metal such as aluminum. Spacer 164 and pins 166 can be secured or attached to heat sink base 162 in different manners. For example, spacer 164 can be attached to heat sink base 162 by a thermally conductive adhesive. Alternatively, spacer 164 can be attached to heat sink base 162 by a soldering. Further, spacer 164 can be integral with heat sink base 162 making spacer 164 and heat sink base 162 a singular unit. Heat sink base 162 can align with spacer 164 along a central axis (not shown), such that a central axis of heat sink base 162 aligns with a central axis of spacer 164. Additionally, pins 166 of heat sink 160 can be attached to heat sink base 162 by a thermally conductive adhesive. Alternatively, pins 166 of heat sink 160 can be attached to heat sink base 22 by soldering. In some embodiments, pins 166 of heat sink 160 can be integral with heat sink base 162 making pins 166 and heat sink base 162 a singular unit. Further, in some embodiments, spacer 164, the plurality of pins 166 and heat sink base 162 can form an integral unitary body for heat sink 160.

Figure 8:
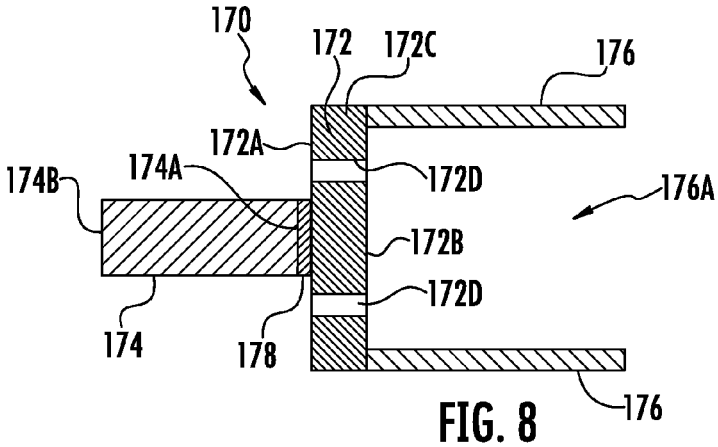
FIG. 8 is a side cross-sectional view illustrating an embodiment of a heat sink according to the subject matter disclosed herein.

FIG. 8 shows an embodiment of a heat sink generally designated 170 that comprises a heat sink base 172 having a top surface 172A, a bottom surface 172B and at least one side edge 172C. Heat sink 170 can comprise a spacer 174 having a first end 174A and a second end 174B. Spacer 174 can be attached at first end 174A via a thermally conductive adhesive 178 to top surface 172A of heat sink base 172. Spacer 174 can extend upward and orthogonally away from top surface 172A of heat sink base 172. Spacer 174 can have a mounting area on second end 174B on which an LED can be disposed in some manner, for example, as described above. A plurality of pins 176 can be attached to and extend downward from bottom surface 172B of heat sink base 172 in a single row adjacent side edge 172C of heat sink base 172 to form an interior cavity 176A between the plurality of pins 176. As shown in FIG. 8, heat sink base 172 of heat sink 170 can have two apertures 172D that extend through heat sink base 172. Such apertures 172D can be used to pass wires (not shown) therethrough.

Figure 9:
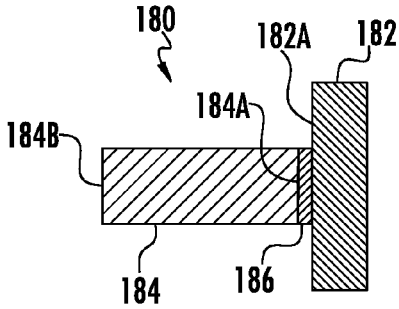
FIG. 9 is a side cross-sectional view illustrating another embodiment of a heat sink according to the subject matter disclosed herein.

FIG. 9 shows an embodiment of a heat sink generally designated 180 that comprises a heat sink base 182 having a top surface 182A and a spacer 184 having a first end 184A and a second end 184B. Spacer 184 can be attached at first end 184A via a thermally conductive adhesive 186 to top surface 182A of heat sink base 182. Spacer 184 can extend upward and orthogonally away from top surface 182A of heat sink base 182. Spacer 184 can have a mounting area, or pad, on second end 184B on which an LED can be disposed in some manner, for example, as described above.

Figure 10:
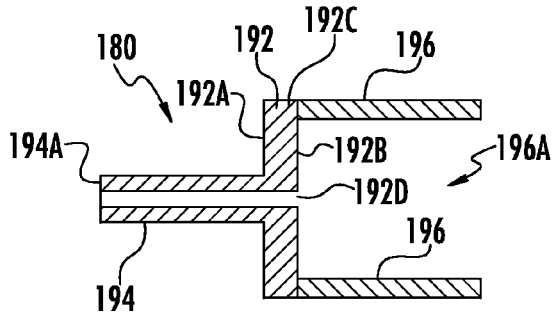
FIG. 10 is a side cross-sectional view illustrating a further embodiment of a heat sink according to the subject matter disclosed herein.

FIG. 10 shows an embodiment of a heat sink generally designated 190 that comprises a heat sink base 192 having a top surface 192A, a bottom surface 192B and at least one side edge 192C. Heat sink 190 can comprise a spacer 194 that is integral with heat sink base 192. Spacer 194 can extend upward and orthogonally away from top surface 192A of heat sink base 192. Spacer 174 can have an end 194A that is distal from heat sink base 192. An LED can be disposed in some manner, for example, as described above, on end 194A of spacer 194. A plurality of pins 196 can be attached to and extend downward from bottom surface 192B of heat sink base 192 in a single row adjacent side edge 192C of heat sink base 192 to form an interior cavity generally designated 196A between the plurality of pins 196. As shown in FIG. 10, heat sink base 192 and spacer 194 can have an aperture 192D that extends through both heat sink base 192 and spacer 194. Aperture 192D can be centrally located through heat sink base 192 and spacer 194. Such an aperture 192D can be used to pass wires (not shown) therethrough.

Referring to FIGS. 11 and 12, an LED lamp can comprise a heat sink 20 that can comprise a spacer 24 having a width $W_S$ and a mounting area 24C disposed along a plane P. In some embodiments, spacer 24 of heat sink 20 can be attached to a heat sink base 22. An LED 18 can be mounted on mounting area 24C of spacer 24. A lens 14 can be disposed over LED 18 with lens 14 extending outwardly beyond width $W_S$ of spacer 24 as shown in FIG. 11. First lens 14 can be configured to transmit light LR from LED 18 above and below plane P of mounting area 24C of spacer 24. An overhanging distance $D_L$ of lens 14 can form a bottom lens portion 14A that permits the light emitted from LED 18 to be refracted by lens 14 and then transmitted out of bottom lens portion 14A to shine downwardly from lens 14. Lens 14 can thus help produce nearly omnidirectional light output from the LED lamp. By placing LED 18 on mounting area 24C of spacer 24 and having lens 14 overhanging spacer 24, separation between lens 14 and the element on which spacer 24 is position is formed to allow light LR to shine downward. In such an embodiment, light LR from LED 18 transmitted through lens 14 above and below plane P of mounting area 24C of spacer 24 can have a radius a that is greater than approximately 180°. In some embodiments, light LR from LED 18 transmitted through lens 14 above and below plane P of mounting area 24C of spacer 24 can have a radius a that is approximately 270° or greater.

In some more elaborate embodiments as described above, FIGS. 11 and 12 illustrate how, in a lighting unit 12 that can be used in an LED lamp, light can reflected or refracted downward to form a wide radius of light emitted from lighting unit 12. Lighting unit 12 can comprise a mounting substrate 16 having a top surface a bottom surface and side edges (not labeled in FIGS. 11 and 12 for clarity). LED 18 can be an LED package 18 that can be disposed on top surface 16A of mounting substrate 16. Lens 14 can be disposed over LED package 18 and the mounting substrate 16 with lens 14 being attached to mounting substrate 16 and extending outward from side edges 16C of mounting substrate 16 to form a bottom lens portion 14A. Producing nearly omnidirectional light output from lighting unit 12 can be achieved with such a lens 14 (which can be considered a secondary optic to the LED package lens on LED package 18). For example, lens 14 can comprise a diffuser dome that refracts at least a portion of the light generated by the LED chip downward through bottom lens portion 14A. For example, as shown in FIG. 12, a light ray LR can be emitted by LED package 18. Light ray LR can be refracted off of lens 14 so that light ray LR exits lighting unit 12 from bottom lens portion 14A. For example, the distance $D_L$ that lens 14 extends out from side edges of mounting substrate 16 can form a bottom lens portion 14A that can be large enough to permit enough refracted light that passes through bottom lens portion 14A to form a large radius a of emitted light. Further, the amount of light rays LR emitted from lighting unit 12 can be enhanced by attaching mounting substrate 16 to a spacer 24 of a heat sink 20 above a heat sink base 22 to add separation between lighting unit 12 and heat sink base 22. Spacer 24 can have a width $W_S$ that can be less than a width $W_{MS}$ of mounting substrate 16. In this manner, the amount of light emitted from lighting unit 12 that is generally blocked by spacer 24 can be greatly reduced or minimized. Further, spacer 24 can have a length $L_S$, as shown in FIG. 12 that places mounting substrate 16, LED package 18, and lens 14 above heat sink base 22 on spacer 24 to reduce light loss within an LED lamp.

As shown in FIG. 11 and FIG. 12, the combination of bottom lens portion 14A with the placement of lighting unit 12 on spacer 24 at a distance above heat sink base 22 allows light that would otherwise be reflected upward to exit lens 14 through bottom lens portion 14A downward and increases the amount of light in the greater than 90° beam angle. For example, as shown in FIG. 11, a radius a of light emitted from lighting unit 12 for an LED lamp can be greater than approximately 180°. For example, the radius a of light emitted from lighting unit 12 for an LED lamp can be approximately 270° or greater. By allowing the radius of emitted light to be so large, an LED lamp can closely approximate the light pattern of an incandescent B10 lamp.

Figure 13:
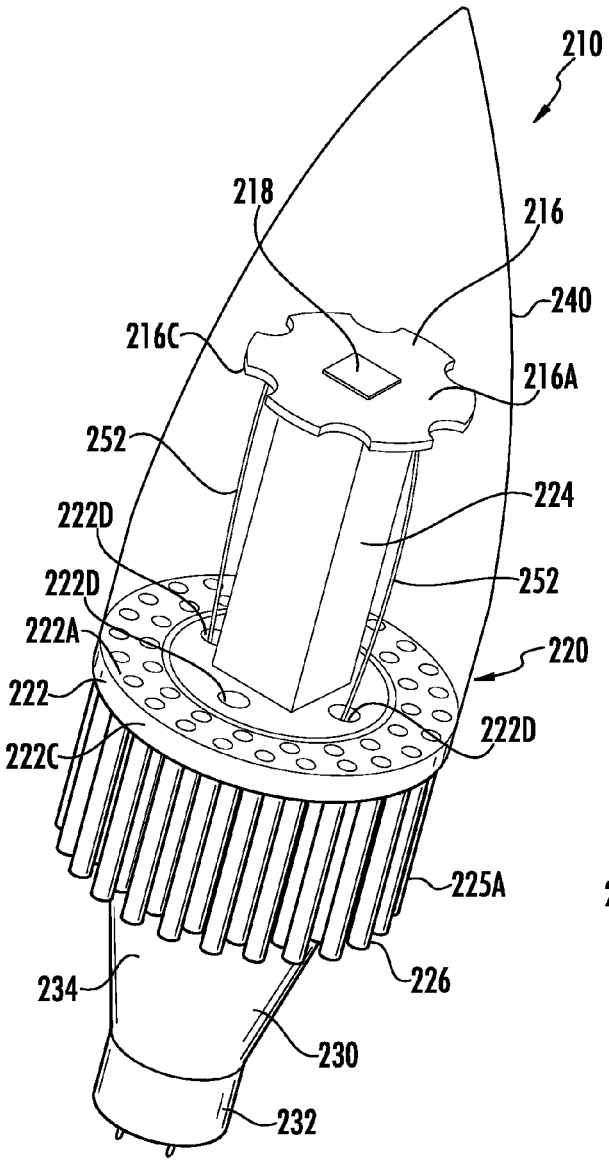
FIG. 13 is a top perspective view illustrating another embodiment of an LED lamp according to the subject matter disclosed herein.
Figure 14:
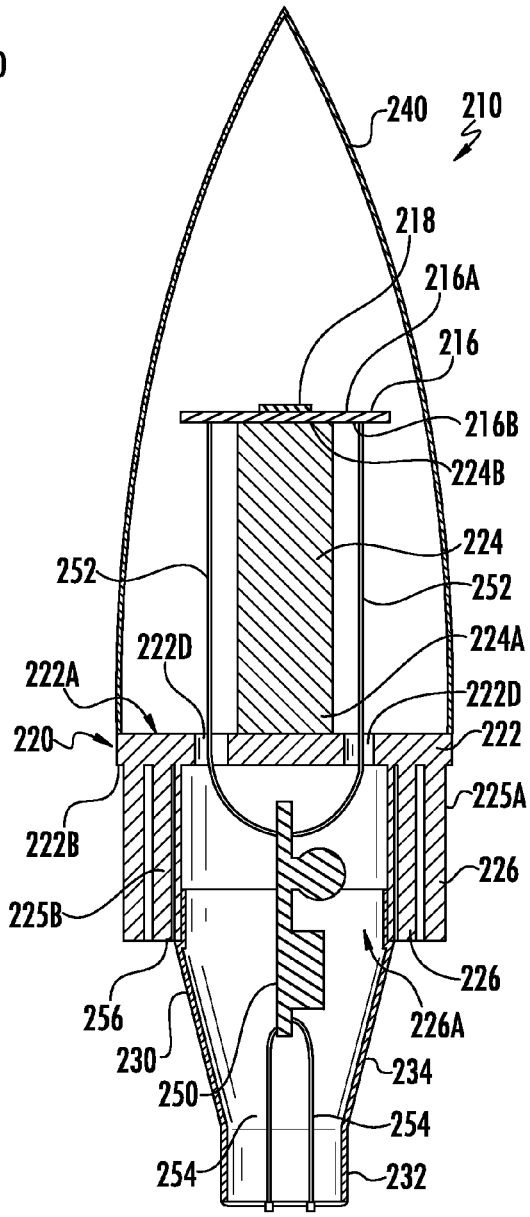
FIG. 14 is a side cross-sectional view illustrating the embodiment of the LED lamp according to FIG. 13.

As shown in FIGS. 13 and 14, a further embodiment of an LED lamp generally designated 210 can comprise a mounting substrate 216 that can have a top surface 216A, a bottom surface 216B and side edges 216C. Mounting substrate 216 can comprise, for example, a printed circuit board (PCB) that is thermally conductive, such as a star-shaped metal core PCB (MCPCB) as shown in FIG. 13. LED package 218 can be disposed on top surface 216A of mounting substrate 216. LED lamp 210 can also comprise a heat sink generally designated 220 that can comprise a heat sink base 222 and a spacer 224. Heat sink base 222 can have a top surface 222A, a bottom surface 222B and at least one side edge 222C. Spacer 224 can have a square or rectangular cross-sectional shape and can have a first end 224A and a second end 224B. Spacer 224 can be attached at first end 224A to top surface 222A of heat sink base 222. Spacer 224 can have a mounting area, or pad, on second end 224B on which mounting substrate 216 can be mounted distal from heat sink base 222. As shown in FIGS. 13 and 14, spacer 224 can have a width that can be less than a width of mounting substrate 216 so that mounting substrate 216 overhangs spacer 222.

LED lamp 210 can also comprise an outer lens 240 that can be secured, for example to heat sink 220. Outer lens 240 can provide optical effect to reflect or refract the light emitted from LED package 218 outward and downward to provide a wide radius of light emitted from LED lamp 210. Outer lens 240 can have a decorative shape. For example, the shape of outer lens 240 can be a blunt torpedo shape, a flame tipped shape, or the like. Outer lens 240 may reflect light, or certain ranges of the light spectrum, to cause the light from LED lamp 210 to resemble a flickering flame. Thus, outer lens 240 can serve as an optical lens that reflects and refracts light from LED package 218. Since spacer 224 can have a smaller width than mounting substrate 216 and since spacer 224 can extend above the wider heat sink base 222 of heat sink 220, heat sink 220 can permit a wide radius of light to be emitted from LED lamp 210. Outer lens 240 can be a decorative shape. For example, the LED lamp with a decorative shaped outer lens 240 can be a candelabra lamp.

Heat sink 220 can also comprise a plurality of pins 226 that can be spaced-apart and extend downward and orthogonally away from heat sink base 222. In the embodiment shown in FIGS. 13 and 14, heat sink base 222 can have a circular cross-sectional shape and the plurality of pins 226 can extend downward from bottom surface 222B adjacent side edge 222C of heat sink base 222 to form an interior cavity 226A between the plurality of pins 226. A driver 250 can be electrically connected to mounting substrate 216 via wires 252 to provide electricity to LED package 218. Driver 250 can also be electrically connected to electrical base 230 via wires 254. In the shown embodiment, electrical base 230 can comprise a GU-24 socket engaging portion 232 and an insulator portion 234 which can be plastic, glass or the like. Electrical base 230 can be attached to heat sink 220 in different manners. For example, in the embodiment shown, electrical base 230 can be attached to heat sink base 222. Further, insulator portion 234 of electrical base 230 can comprise protective cylinder 256.

As shown in FIGS. 13 and 14, heat sink base 222 can have apertures 222D that extend therethrough. Wires 252 of driver 250 can pass through apertures 222D to electrically connect driver 250 to LED package 218 through the MCPCB mounting substrate 216. As shown in FIGS. 13 and 14, wires 252 pass on the outside of spacer 224. To make space for driver 250, pins 226 from the heat sink 220 can comprise two outer off-set rows, or rings, 225A, 225B of pins 226 to form cavity 226A in which to mount driver 250. Heat sink 220 can for example carry a 150 W thermal load at steady state in a 25° C. ambient operating environment. The highest temperature of LED lamp 210 can be at the solder point while the LED/heat sink boundary can be for example be approximately 76° C., or 51° C. above ambient, or less. The thermal resistance of LED package 218 can for example be approximately 2.5° C./W, so the junction temperature can for example be approximately 89° C. For example and based upon operating conditions, LED lamp 210 with heat sink 220 can have a predicted L70 lifetime based upon standard modeling practices for lighting of at least 50,000 hours or greater. For example, maximum temperature for the 4-LED configuration of XP-G LEDs at 700 mA in a 25° C. ambient temperature can for example be approximately 67° C. A high temperature for an 8-LED configuration of LEDs or LED packages at 350 mA in a 25° C. ambient temperature can for example be approximately 53° C. It is noted that the surface temperature of LED lamp 210 can be maintained well below approximately 55° C. For example, the surface temperature of LED lamp 210 can be maintained at approximately 45° C. or less. By comparison, the surface temperature of a fixture using an incandescent lamp typically will have a temperature of above approximately 100° C.

LED lamps as described in the present disclosure can be manufactured. For example, a method of manufacturing such an LED lamp can comprise providing a heat sink for an LED package. The heat sink can comprise a heat sink base having a top surface, a bottom surface and at least one side edge and a spacer having a first and second end. The spacer can be attached to the top surface of the heat sink base at the first end and can extend upward the heat sink base. The spacer can have on the second end a mounting area or pad on which an LED package can be disposed in some manner. The heat sink can also comprise a plurality of pins such as those described herein attached to the bottom surface of the heat sink base and extending downward therefrom. The plurality of pins can define an interior cavity of the heat sink by their placement on the heat sink base. The method can also comprise attaching a mounting substrate having an LED package disposed on a top surface of the mounting substrate to the mounting area on the spacer so that the mounting substrate overhangs the spacer. A lens can be attached over at least the LED package and the mounting substrate. For example, a lens, in the form of a diffuser dome, can be fastened to the mounting substrate so that the diffuser dome extend outward from side edges of the mounting substrate to form a bottom lens portion.

Further, in some embodiments, the method can include having a driver inserted into the interior cavity of the heat sink and electrically connecting the driver to the LED package. In another step, the driver can be electrically connected to an electrical base configured to engage a light fixture and the electrical base can be attached to the heat sink. In another step, a hole can be drilled through the heat sink base and wires of the driver can be inserted therethrough to electrically connect the driver to the LED package. Additionally, in some embodiments, an outer lens can be attached to the heat sink so that the outer lens is disposed over the mounting substrate, the LED package, and the spacer of the heat sink.

In some embodiments according to the present disclosure, driver input wires can be connected to an electrical base power connection. The driver can be wrapped in an insulative adhesive tape, such as Kapton® silicon adhesive tape, to isolate the driver from the heat sink and provide thermal protection. The LED packages can be soldered onto the mounting substrate, such as a MCPCB, with an appropriate solder paste and reflow profile. The flux residue can be cleaned off or removed with isopropyl alcohol. A spacer can be attached to the base of the heat sink using Arctic Silver® thermal epoxy manufactured by Artic Silver, Incorporated, located in Visalia, Calif. Two apertures can be drilled through the base of the heat sink on its diameter to permit the driver output wires to be connected to the mounting substrate such as a MCPCB. The driver can be inserted into the heat sink and the DC output wires can be fed through the apertures. The wire can then be soldered to the corresponding terminal pads on the mounting substrate, such as a MCPCB. The lens for the lighting unit can be fastened to the mounting substrate in an appropriate manner. A thin layer of thermal conductive compound can be applied to the back of mounting substrate and the mounting substrate can be secured to the spacer of the heat sink. An outer lens can be fastened to the heat sink with an adhesive such as an epoxy. The electrical base can also be attached to the heat sink with an adhesive such as an epoxy.

Embodiments of the present disclosure shown in the drawings and described above are exemplary of numerous embodiments that can be made within the scope of the appended claims. It is contemplated that the configurations of LED lamps, heat sinks and related methods can comprise numerous configurations other than those specifically disclosed herein. cm What is claimed is:

What is claimed is:

1. A light-emitting die (LED) lamp comprising:

a heat sink comprising a heat sink base and a spacer, the spacer comprising a mounting area that is distal to the heat sink base and disposed along a plane that is substantially parallel to the base;

an LED mounted over the mounting area of the spacer; and a first lens disposed over the LED and portions of the spacer, wherein a bottom portion of the first lens extends to a distance beyond a width of the spacer for transmitting light from the LED both above and below the plane of the mounting area of the spacer.

2. The LED lamp of claim 1, wherein the LED comprises an LED package.

3. The LED lamp of claim 2, wherein the LED package comprises an LED package lens.

4. The LED lamp of claim 3 further comprising an outer lens disposed over the LED package, the first lens and the spacer.

5. The LED lamp of claim 1, further comprising a mounting substrate on the mounting area of the spacer and the LED mounted on the mounting substrate, and wherein the first lens extends beyond the mounting substrate.

6. The LED lamp of claim 5, wherein the mounting substrate comprises a metal core printed circuit board (MCPCB).

7. The LED lamp of claim 1, further comprising an outer lens disposed over the LED, the first lens and the spacer.

8. The LED lamp of claim 7, wherein the outer lens comprises a glass enclosure for reflecting light in a manner that causes the light to resemble a flickering flame.

9. The LED lamp of claim 1, further comprising an electrical base attached to the heat sink and configured to engage a light fixture and a driver in electrical connection with the LED and the electrical base.

10. The LED lamp of claim 1, wherein the heat sink comprises a plurality of pins.

11. The LED lamp of claim 10, wherein the heat sink comprises a heat sink base having a top surface, a bottom surface and at least one side edge and the spacer comprises a first and second end, the spacer being attached to the top surface of the heat sink base at the first end and extending upward therefrom and the mounting area of the spacer being on the second end and wherein the plurality of pins are spaced apart and attached to the bottom surface of the heat sink base and extend downwardly therefrom, the plurality of pins creating an interior cavity in which a driver resides.

12. The LED lamp of claim 11, further comprising a protective cylinder disposed between the plurality of pins and the driver.

13. The LED lamp of claim 11, wherein the heat sink base has a diameter of approximately 32 mm or more.

14. The LED lamp of claim 11, wherein the heat sink base has an aperture therethrough through which wires are passable to connect a driver to the LED package.

15. The LED lamp of claim 1, wherein the light from the LED transmitted through the first lens above and below the plane of the mounting area of the spacer has a radius that is greater than approximately 180°.

16. The LED lamp of claim 1, wherein the light from the LED transmitted through the first lens above and below the plane of the mounting area of the spacer has a radius that is approximately 270° or greater.

17. The LED lamp of claim 1 wherein the lamp is configured to be a candelabra lamp.

* * * * *